US007284399B1

(12) United States Patent
Sisco

(10) Patent No.: US 7,284,399 B1
(45) Date of Patent: Oct. 23, 2007

(54) INMATE TRANSPORT RESTRAINT

(76) Inventor: Vernon G. Sisco, 1203 Catina Dr., Nashville, TN (US) 37217

( * ) Notice: Subject to any disclaimer, the term of this patent is extended or adjusted under 35 U.S.C. 154(b) by 0 days.

(21) Appl. No.: 11/393,289

(22) Filed: Mar. 30, 2006

Related U.S. Application Data

(63) Continuation-in-part of application No. 11/031,575, filed on Jan. 6, 2005.

(60) Provisional application No. 60/623,319, filed on Oct. 29, 2004.

(51) Int. Cl.
*E05B 75/00* (2006.01)

(52) U.S. Cl. ..... 70/16; 128/878; 119/816; 24/16 PB

(58) Field of Classification Search ..... 70/14–19; 119/816, 819; 128/878, 879; 24/16 PB
See application file for complete search history.

(56) References Cited

U.S. PATENT DOCUMENTS

| | | | | | |
|---|---|---|---|---|---|
| 381,005 | A | * | 4/1888 | Ferrell | 70/16 |
| 567,049 | A | | 9/1896 | Smith | 119/804 |
| 583,796 | A | * | 6/1897 | Ferrell | 70/16 |
| 711,778 | A | * | 10/1902 | Mealer | 70/16 |
| 1,056,079 | A | * | 3/1913 | Wood | 70/16 |
| 1,252,517 | A | * | 1/1918 | Walden | 70/16 |
| 1,462,238 | A | | 7/1923 | Mennillo | 70/15 |
| 1,477,777 | A | * | 12/1923 | Shek | 70/38 C |
| 1,478,999 | A | | 1/1924 | Johnson | 119/804 |
| 1,509,335 | A | * | 9/1924 | Bockin | 70/16 |
| 1,732,225 | A | | 10/1929 | John | 70/16 |
| 1,803,280 | A | | 4/1931 | Stull et al. | 70/16 |
| 1,806,163 | A | | 5/1931 | John | 70/16 |
| 1,883,598 | A | | 10/1932 | Dahl | 119/803 |
| 2,388,766 | A | | 11/1945 | Ruttiman | 70/16 |
| 2,582,339 | A | | 1/1952 | Krueger | 119/153 |
| 3,165,801 | A | | 1/1965 | Stansbury | 24/134 R |
| 3,319,609 | A | | 5/1967 | Pickard et al. | 119/153 |
| 3,435,642 | A | | 4/1969 | Pesco | 70/49 |
| 3,616,665 | A | | 11/1971 | Rosenthal | 70/16 |
| 3,740,977 | A | | 6/1973 | Stefansen et al. | 70/16 |
| 3,747,164 | A | | 7/1973 | Fortsch | 24/16 PB |
| 4,071,023 | A | | 1/1978 | Gregory | 128/878 |
| 4,458,385 | A | | 7/1984 | Espinoza | 24/16 PB |
| 4,574,434 | A | | 3/1986 | Shupe | 24/16 PB |
| 4,813,105 | A | | 3/1989 | Espinoza | 24/16 PB |
| 4,840,048 | A | * | 6/1989 | Elam | 70/16 |
| 4,854,138 | A | | 8/1989 | Charland | 70/16 |
| 4,909,051 | A | | 3/1990 | Lee | 70/16 |
| 4,910,831 | A | | 3/1990 | Bingold | 24/16 |

(Continued)

*Primary Examiner*—Suzanne Dino Barrett
(74) *Attorney, Agent, or Firm*—Stites & Harbison PLLC; Richard S. Myers, Jr.

(57) ABSTRACT

An inmate transport restraint which comprises a handcuff having two loops formed from two straps, each strap separately inserted into a housing, wherein each housing has a first channel and a second channel, with the strap passing through each channel, the second channel adapted for releasably retaining a free end of the strap and the first channel retaining a stop end of the strap in a semi-permanent manner, the housing further containing a key-operated lift cam that cooperates with a tension spring to releasably retain the strap within the housing. The restraint further comprises a handcuff cover which fits over a portion of the handcuff to limit access and movement of the hands and wrists. The cover cooperates with a link pin, attached to a belly chain, to secure an inmate for transport.

17 Claims, 10 Drawing Sheets

U.S. PATENT DOCUMENTS 5,007,257 A * 4/1991 Thompson ..... 70/16
5,099,662 A 3/1992 Tsai ..... 70/16
5,230,541 A 7/1993 Nowak ..... 292/288
5,233,848 A * 8/1993 Elam ..... 70/16
5,345,947 A 9/1994 Fisher ..... 128/878
5,377,510 A 1/1995 Smith ..... 70/16
5,398,383 A * 3/1995 Bingold ..... 24/16 PB
5,443,155 A 8/1995 Robinson ..... 206/223
5,460,373 A 10/1995 McNutt ..... 273/84 R
D366,129 S 1/1996 Escoe, III ..... D29/120
5,518,010 A 5/1996 Dodge ..... 128/869
5,526,658 A * 6/1996 Cross et al. ..... 70/16
5,644,819 A 7/1997 Lyons ..... 24/20 R
5,680,781 A 10/1997 Bonds et al. ..... 70/16
5,704,097 A 1/1998 Rahav ..... 24/16 PB
5,732,576 A 3/1998 Moore et al. ..... 70/16
5,794,461 A 8/1998 Smith ..... 70/16
5,797,404 A 8/1998 Stanchin, II ..... 128/869
6,000,249 A * 12/1999 Wilber ..... 70/16
6,012,416 A 1/2000 Lammers ..... 119/804
6,196,033 B1 3/2001 Dowdle ..... 70/16
6,334,444 B1 1/2002 Sisco ..... 128/869
6,364,257 B1 4/2002 Holder ..... 248/74.3
6,446,474 B1 9/2002 Tabacchi ..... 70/16
6,616,107 B1 9/2003 Hargreaves ..... 248/68.1
6,886,374 B2 * 5/2005 Clifton, Jr. ..... 70/16
7,010,943 B1 * 3/2006 Earl ..... 70/16
2004/0016085 A1 1/2004 Caveney ..... 24/16 PB

* cited by examiner

INMATE TRANSPORT RESTRAINT

CROSS-REFERENCES TO RELATED APPLICATIONS

This application is a Continuation-In-Part application which claims benefit of co-pending U.S. patent application Ser. No. 11/031,575 filed Jan. 6, 2005, entitled "Restraint Device" which is hereby incorporated by reference and which claims the benefit of U.S. Provisional Patent Application Ser. No. 60/623,319 filed Oct. 29, 2004 and entitled "Restraint Device" which is also incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to human restraint devices. More particularly, this invention pertains to a humane restraint device and a system and method of restraint for the transport of inmates consisting of a handcuff, handcuff cover and a belly chain link pin, which cooperate in a unique manner with each other.

The restraint of the present invention overcomes some of the problems of the prior art restraints. The handcuff of the present invention utilizes a wide strap for the wrists instead of a narrower strap that can cut into the wrists and cause injury. The wrist straps of the present invention cannot be bent or pried to cause failure of the operating mechanism, unlike prior art metal handcuff restraints.

Unlike handcuff covers in the prior art, the handcuff cover of the present invention, with its 35 degree angles, allows the hand and forearms of a restrained individual to relax in a more normal posture.

Further, the belly chain link pin when attached to the handcuff cover will allow semi-rotational movement of the hands and forearms of a restrained individual to stimulate circulation.

Various types and constructions of flexible material wrist restraints for use by law enforcement personnel in dealing with subduing suspects and controlling prisoners are known. Such restraints in most instances are made of a polymeric based material and embody a strap which can be formed into loops for girding both wrists of a person, and means to secure or lock the loops, the locking means commonly being teeth or projections carried on the strap and a cooperating latch or stop usually carried elsewhere on the strap for engaging the teeth or projections to effect a stop function which secured the loops. Typically, these devices are constructed so that locking mechanism only allows the strap to move in one direction such that the loops can be made smaller but cannot be made larger. This type of restraint is not suitable for the routine transport of inmates. Such restraints are favored in part because they are lightweight, easy to carry and inexpensive. These restraints are typically not suitable to be used more than once.

Representative of the mentioned constructions are U.S. Pat. Nos. 4,071,023; 4,909,051; 4,910,831; 5,088,158 and 5,159,728. These patents disclose generally flat straps for use as the loop forming component.

U.S. Pat. Nos. 567,049; 1,478,999; 1,883,598; 2,582,339; and 3,319,609 teach restraint devices for holding animals, in particular pigs. Although these devices each have a loop which can be tightened, they are designed to hold the snout, or some other body part, of an animal and are not suitable for use on humans.

Because of the material and/or design, these types of restraints are suitable only for a single-use or a limited number of uses, as the restraints are constructed from material which can weaken and fail if used multiple times. These restraints are intended to be used once and disposed of.

Accordingly, what is needed is a restraint system which provides a handcuff with the advantages associated with a wide nylon strap material but also provides a secure, key-operated locking mechanism that can be reused, allowing the inexpensive strap to be replaced as needed while maintaining a secure locking mechanism and a handcuff cover that when applied to the handcuffs allows the hands and arms of an individual to rest in a relaxed position and a belly chain with a belly chain link pin that when secured into the handcuff cover will allow semi-rotational movement of the individual's hands and arms to stimulate circulation while maintaining a secure restraint system.

BRIEF SUMMARY OF THE INVENTION

The present invention relates to an inmate transport restraint device and system which comprises a handcuff that utilizes wide nylon straps, a handcuff cover angled to allow hands and arms to relax in a more normal position and a belly chain link pin that secures the handcuff and cover together to restrain an individual. The handcuff comprises a loop formed from a strap and a housing through which the strap is inserted, wherein the housing has a first channel and a second channel, with the strap passing through each channel, the second channel adapted for releasably retaining a free end of the strap and the first channel retaining a stop end of the strap in a semi-permanent manner, the housing further containing a lift cam, a tension spring for releasably retaining the strap within the housing, wherein the tension spring is adapted to cooperatively work with the lift cam to releasably retain said strap, and a swivel connection link attached to the exterior of said housing to attach two housings together by means of a chain or other fetter.

Accordingly, it is an object of this invention to provide an effective and secure means for the transport of inmates.

It is a further object of this invention to reduce the physical fatigue and injury of restrained individuals during transport.

It is a further object of this invention to provide a transport restraint that is releasable by a standard handcuff key.

Yet another object of this invention is to provide a restraint that is adjustable to fit all sizes of wrists and ankles including those in a cast.

DETAILED DESCRIPTION OF THE INVENTION

Figure 1:
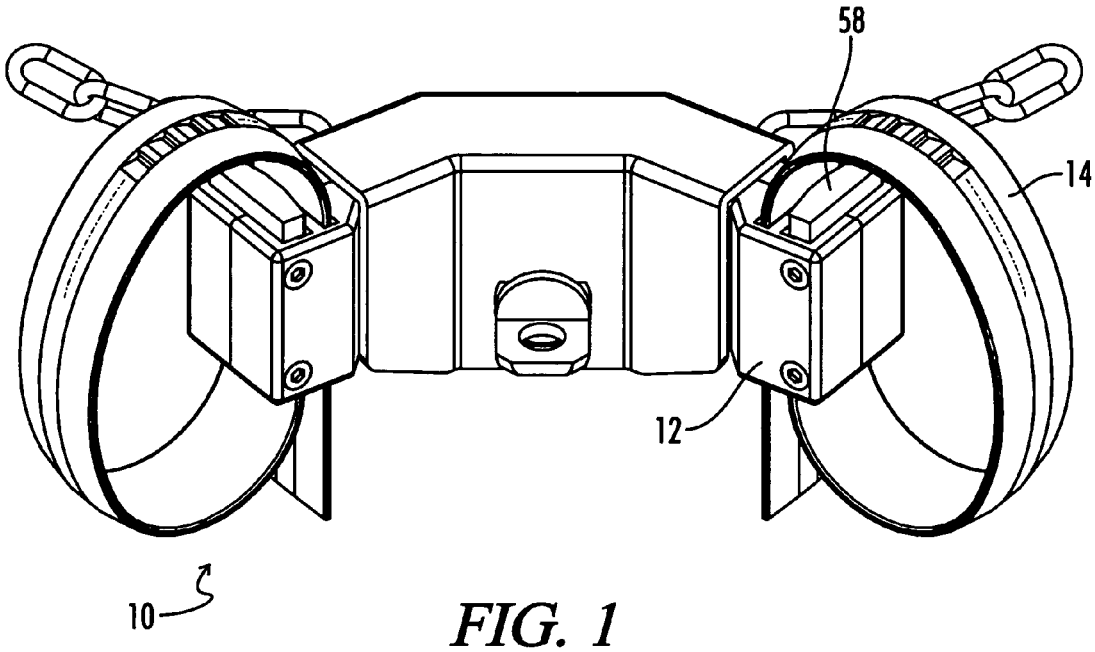
FIG. 1 is a front view of the transport restraint of the present invention.
Figure 9:
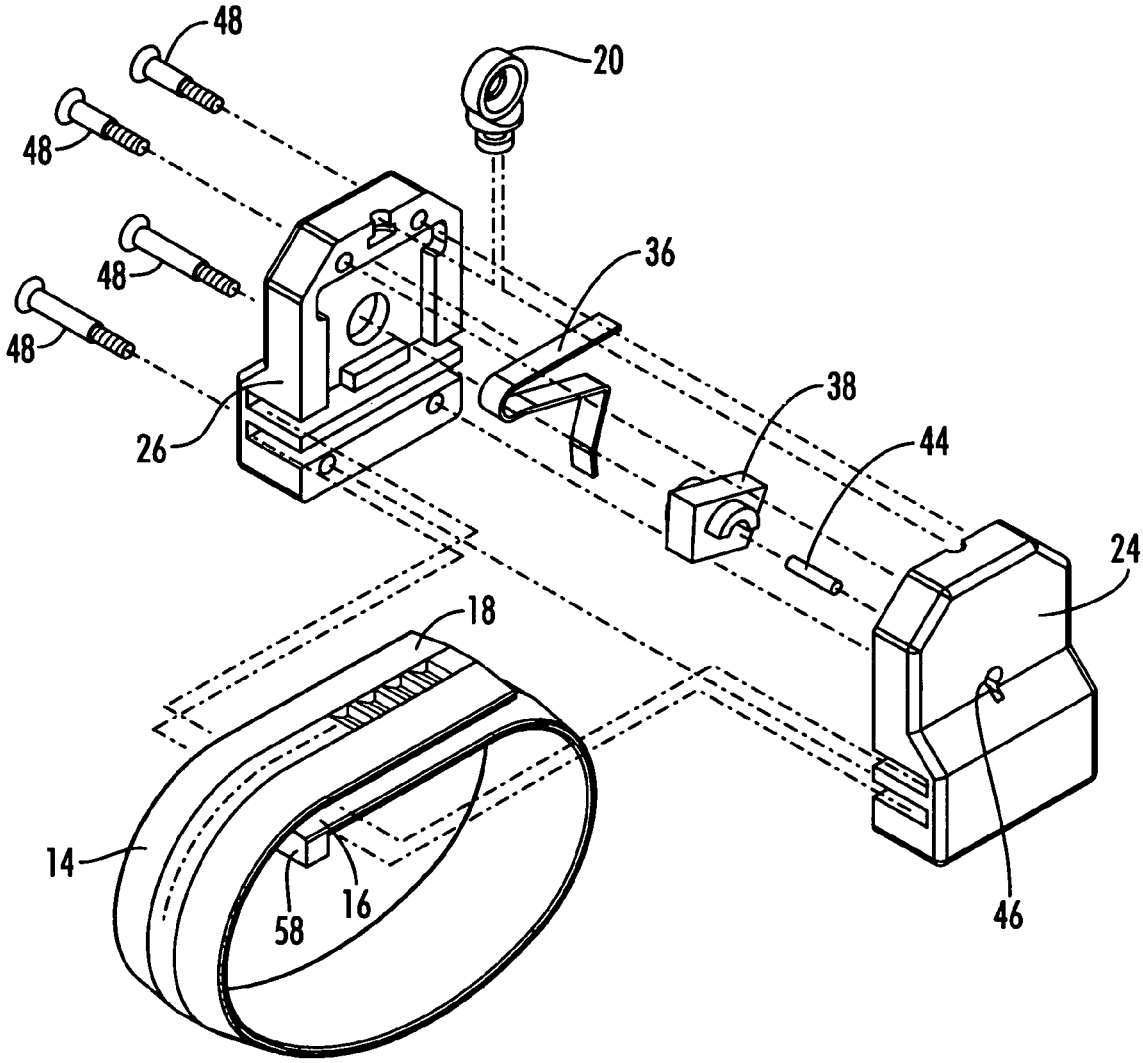
FIG. 9 is an exploded view of the handcuff.

Referring now to the drawings, wherein like reference numerals refer to like parts throughout, the handcuff of the present invention is referred to as 10. As shown in FIGS. 1 and 9, the handcuff 10 comprises a housing 12 and a strap 14. The strap 14 passes through the housing 12 and forms a loop through which a person's hand or foot is passed so that the loop can be tightened around the wrist or ankle to restrain the person. The strap 14 may also be wrapped around a person's foot or hand and then secured with the housing 12. It is contemplated that the present invention would be useful in restraining inmates as well as restraining persons in medical, psychiatric or other settings where restraint is necessary.

Figure 10:
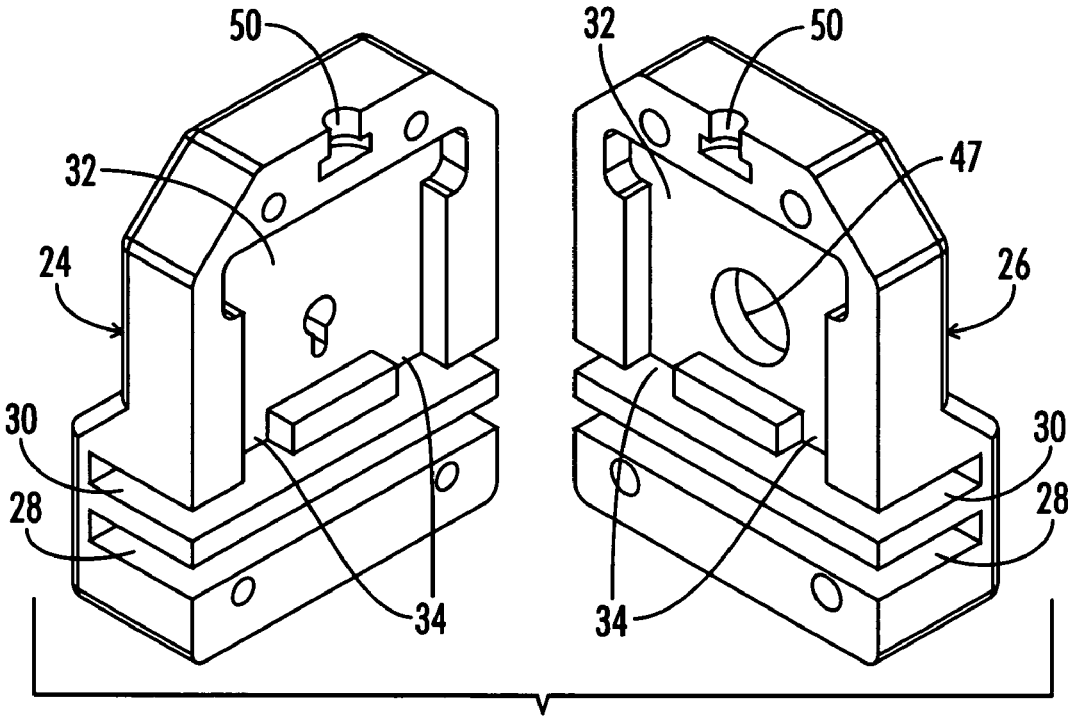
FIG. 10 is a view of the interior of the housing of the handcuff.
Figure 11:
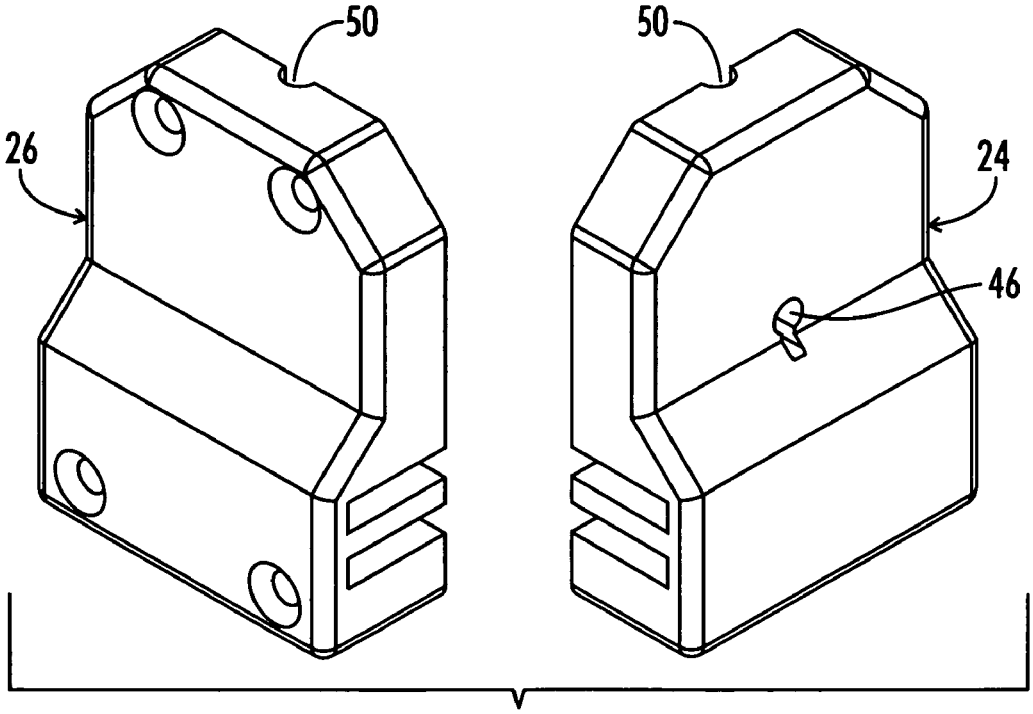
FIG. 11 is a view of the exterior of the housing of the handcuff.

Referring now to FIG. 9, the housing 12 is comprised of a front plate 24 and a rear plate 26. In the preferred embodiment, the housing 12 is constructed from impact plastic or 7075 aluminum. The tension spring 36, lift cam 38 and pin 44 fit inside the housing 12. In a preferred embodiment, front plate 24 and rear plate 26 each have four holes which align so that the plates may be attached to one another by security head screws 48. However, it is contemplated that the front plate and rear plate can be connected or attached in numerous ways which are known to those of skill in the art. FIGS. 9 and 10 also illustrate keyhole 46 in front plate 24, key 22, and restraint connection attachment 20, also referred to as swivel 20.

Figure 3:
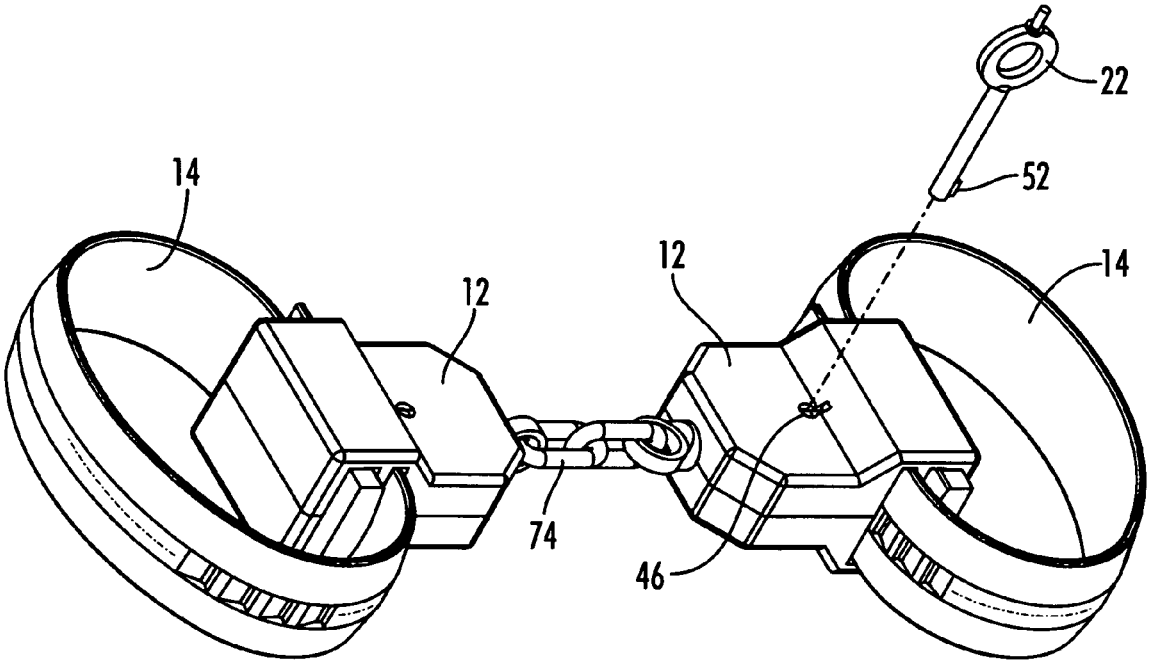
FIG. 3 is a front view of the handcuff of the present invention.

As shown in FIG. 10, the plates of the housing 12 are each formed with first channel 28, second channel 30, chamber 32, and spring slot 34. When front plate 24 and rear plate 26 are aligned, the channels, chamber, and spring slot form hollow enclosures. Front plate 24 and rear plate 26 are identical except that in the preferred embodiment illustrated in the figures, front plate 24 contains a keyhole 46 (FIG. 3) into which a key may be inserted to operate the lift cam 38 to release the strap 14. FIG. 10 also illustrates attachment point 50, or restraint connection attachment 50, where swivel 20 is attached to housing 12.

Figure 12:
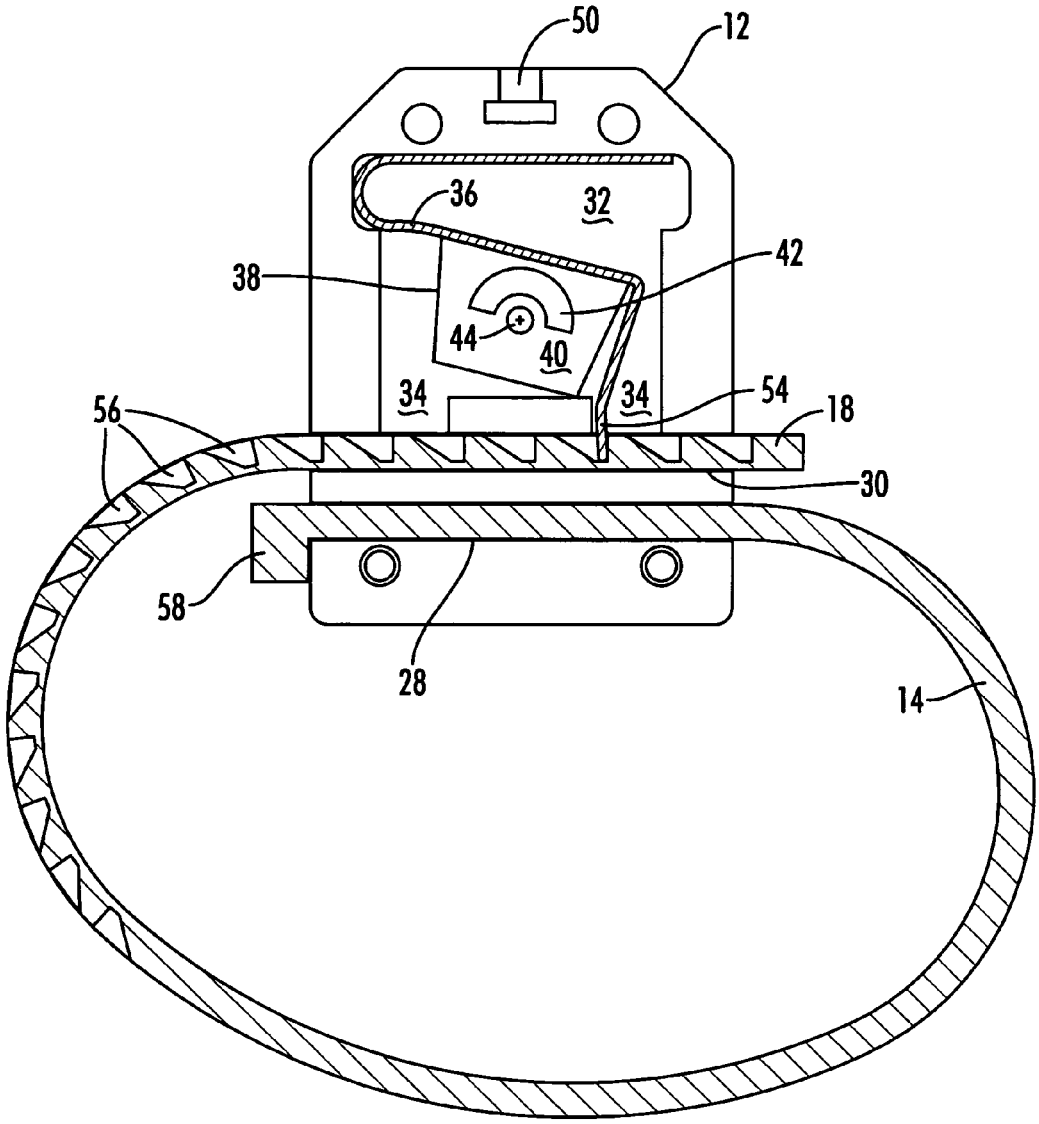
FIG. 12 is a cross section of the rear plate of the handcuff.
Figure 13:
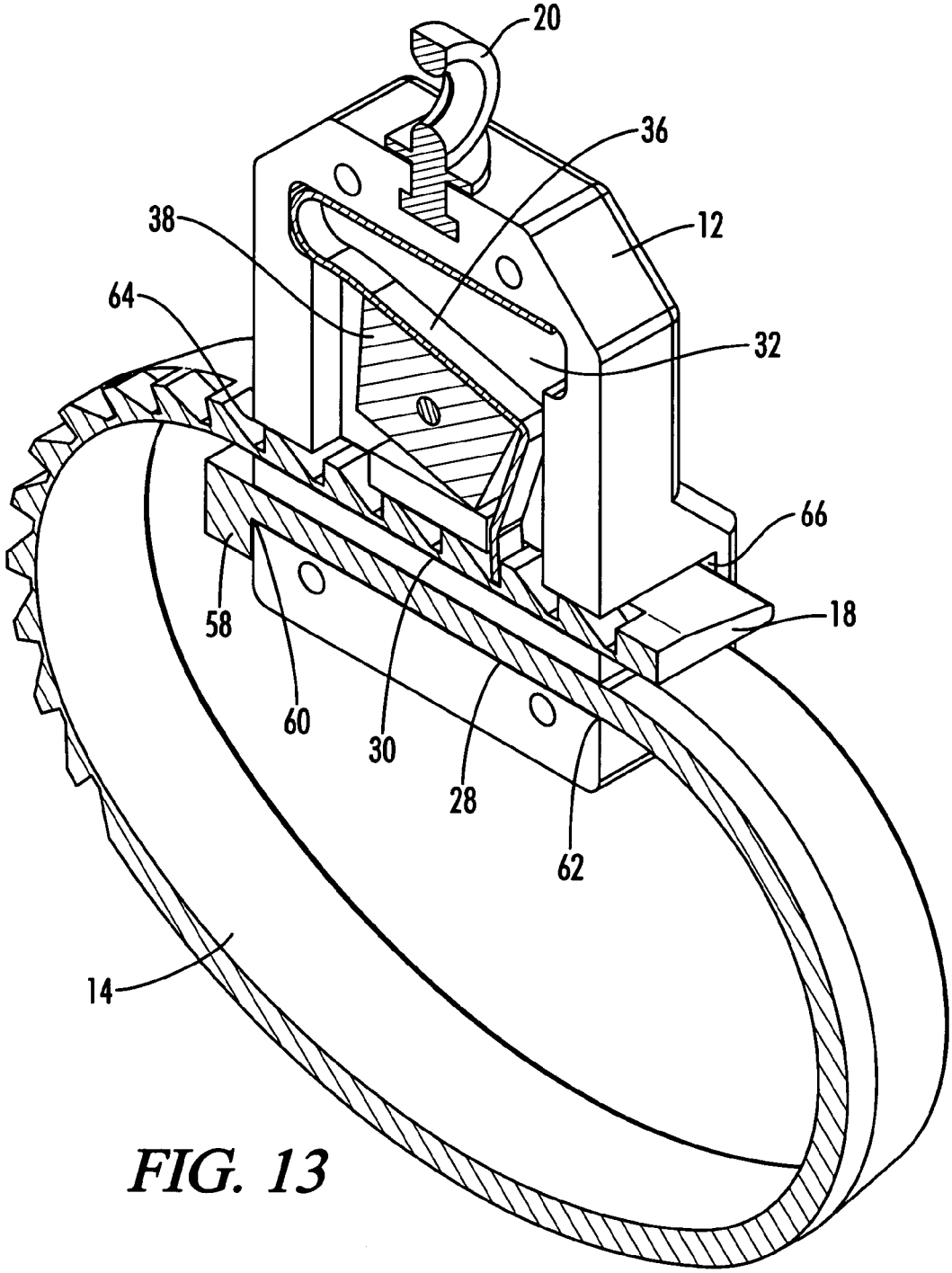
FIG. 13 is a cutaway view of the interior of the handcuff.
Figure 14:
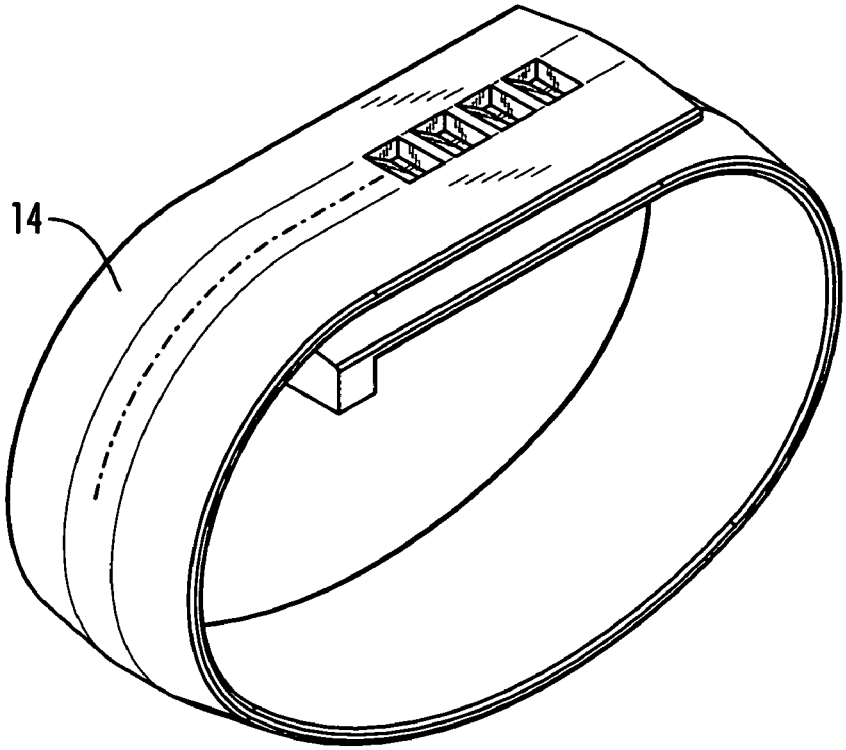
FIG. 14 is a view of the strap formed into a loop.
Figure 15:
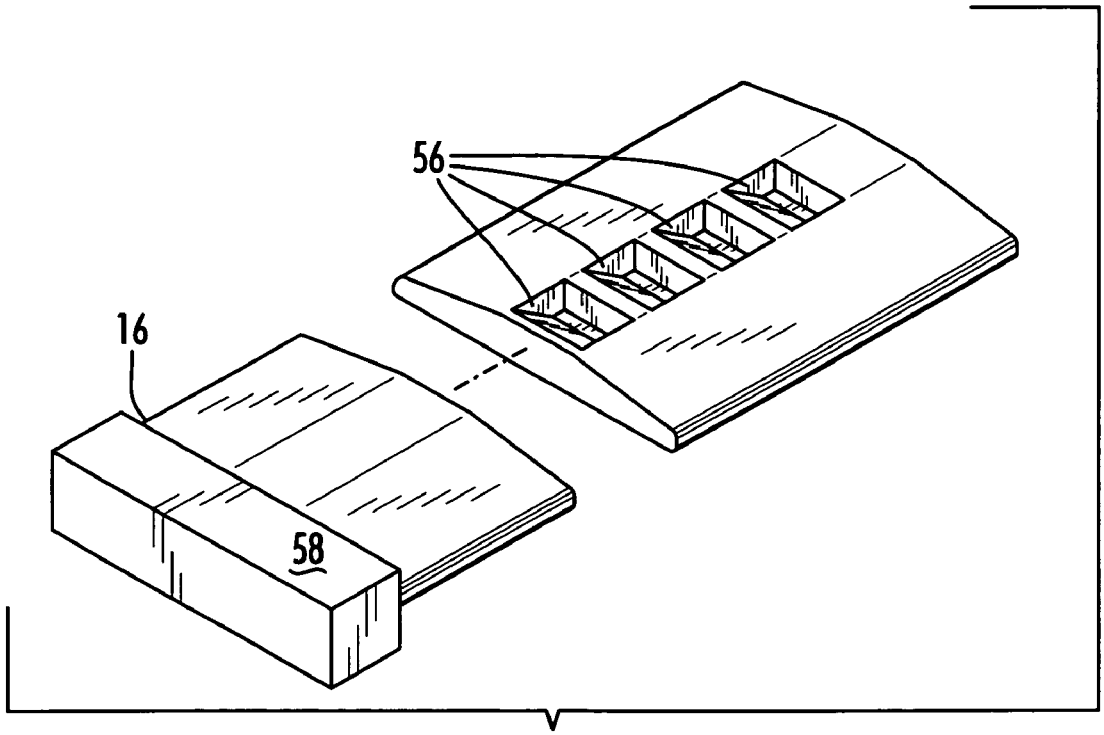
FIG. 15 is a view of the stop end of the strap and of the slots in the strap.

FIG. 13 shows the housing 12 with the lift cam 38 and tension spring 36 in position. The housing 12 forms a hollow chamber 32 into which the lift cam 38 and tension spring 36 fit. The tension spring 36, preferably comprised of spring steel, is configured to fit within the shape of chamber 32 and around lift cam 38. In the locked position, arm 54 of spring 36 extends through spring slot 34 into second channel 30 where it engages strap 14. Specifically, the end of arm 54 engages the slots 56 (FIG. 12) of strap 14 such that when in the locked position, the arm is in one of the slots 56 of strap 14 and strap 14 cannot be removed so that the loop formed by the strap cannot be increased in size and the wrist or ankle around which the loop is fitted cannot be removed from the loop without a key, thus securing the person.

FIG. 12 shows slots 56 in strap 14. In a preferred embodiment, slots 56 could run the entire length of strap 14. However, it is also contemplated that strap 14 could have slots on only part of its length. It is contemplated that the slots 56 could take on any number of shapes known in the art. It is also contemplated that grooves formed in strap 14 could be used instead of slots.

Lift cam 38 is shown in FIG. 12. Lift cam 38 includes cam base 40, wedge 42 and pin 44. In a preferred embodiment, lift cam 38 has a trapezoidal shape. Lift cam 38 is positioned so that keyhole 46 in front plate 24 aligns with pin 44, allowing key 22 to engage pin 44 to rotate cam 38.

Referring to FIG. 13, the free end 18 of strap 14 is pushed through first channel 28, entering first channel 28 at opening 60 and exiting at opening 62. Free end 18 is then inserted into second channel opening 64, exiting at second channel exit 66, forming a closed loop with the strap. Strap 14 is secured on one end by stop 58 on stop end 16, also referred to as opposing end 16, of strap 14, and on the other end by the cooperation of tension spring 36 with the slots 56 (FIG. 12) on strap 14.

To release strap 14 so that the size of the loop may be increased, key 22 is fitted into keyhole 46. When the key 22 is inserted into keyhole 46, the hollow body of the key 22 fits on pin 44. When the key 22 is rotated, key flange 52 engages wedge 42 forcing cam base 40 to rotate. As cam base 40 rotates, it compresses tension spring 36, retracting arm 54 of tension spring 36 out of second channel 30, disengaging arm 54 from the slots 56 of strap 14 thereby releasing the strap 14 so that it can be moved freely though second channel 30.

Strap 14 is a semi-rigid slotted or grooved material and it is contemplated that strap 14 could be formed from any number of materials known to one of skill in the art including nylon-6.6, Tefzel®, Halar®, polypropylene, nylon 4.6 or nylon 12. It is contemplated that the width and the thickness of strap 14 could be of any dimension and that housing 12 could be designed to accommodate various strap dimensions to meet custody and control level requirements when escorting or transporting inmates, making cell moves, or restraining inmates in a hospital setting. The length of strap 14 will also vary based on need.

Figure 5:
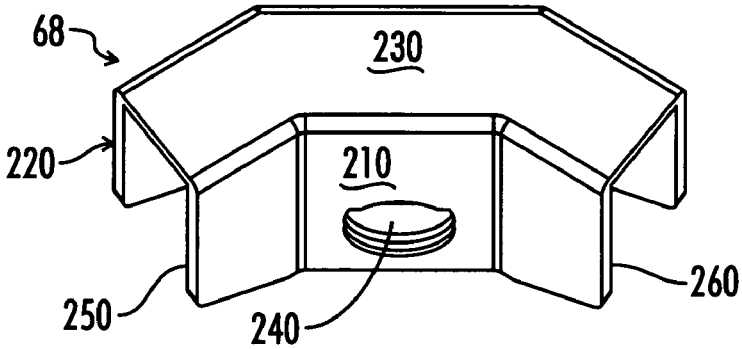
FIG. 5 is a front view of the handcuff cover.
Figure 7:
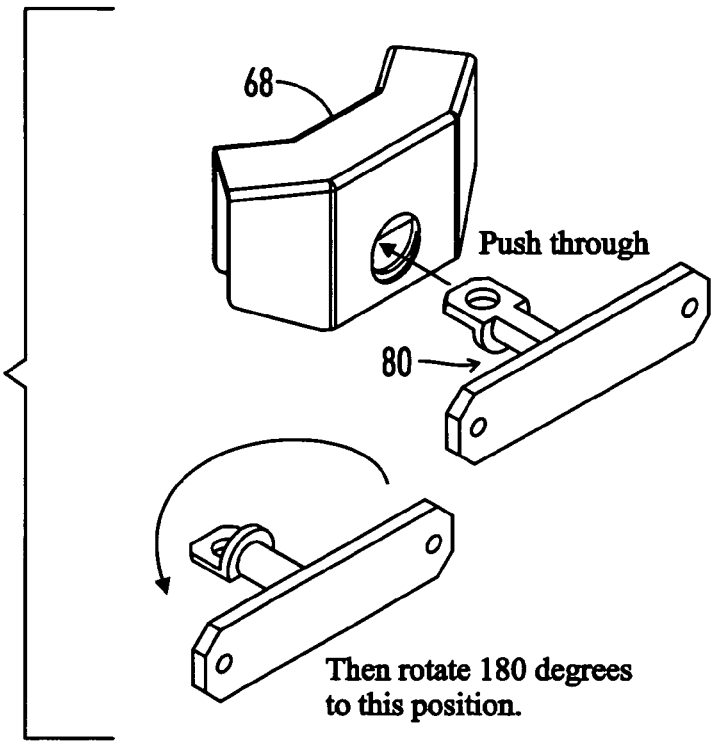
FIG. 7 is an illustration of the link pin and the back of the handcuff cover.
Figure 8:
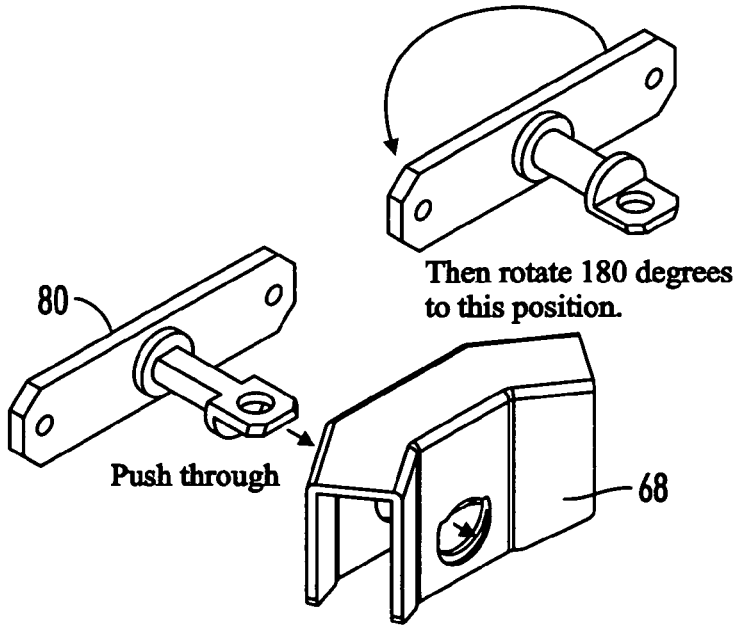
FIG. 8 is an illustration of the link pin and the front of the handcuff cover.

Handcuff 10 can be used with handcuff cover 68. Cover 68 serves further to restrict hand movement and provides a higher level of security, blocking access to the keyway of the handcuff. FIG. 5 shows cover 68 is comprised of front 210 and back 220 joined together by top 230. The bottom and sides of cover 68 are open. Front 210 has a semicircle-shaped hole 240 which aligns with a semicircle-shaped hole (shown in FIG. 7) in back 220. It is contemplated that back 220 could have a full circle hole. In a preferred embodiment, ends 250, 260 are angled toward front 210 of cover 68, preferably at an angle of approximately 35 degrees. Angled ends 250, 260 allow the restrained individual's hands and arms to relax in a more normal position, improving circulation.

Chain 74, also referred to as fetter 74, (shown in FIG. 3) is inserted into the open edge of cover 68 so that cover 68 encloses chain 74 and partially covers housing 12, including keyhole 46, providing a rigid link between straps 14 of the handcuff 10, thus blocking access to the keyholes.

Figure 2:
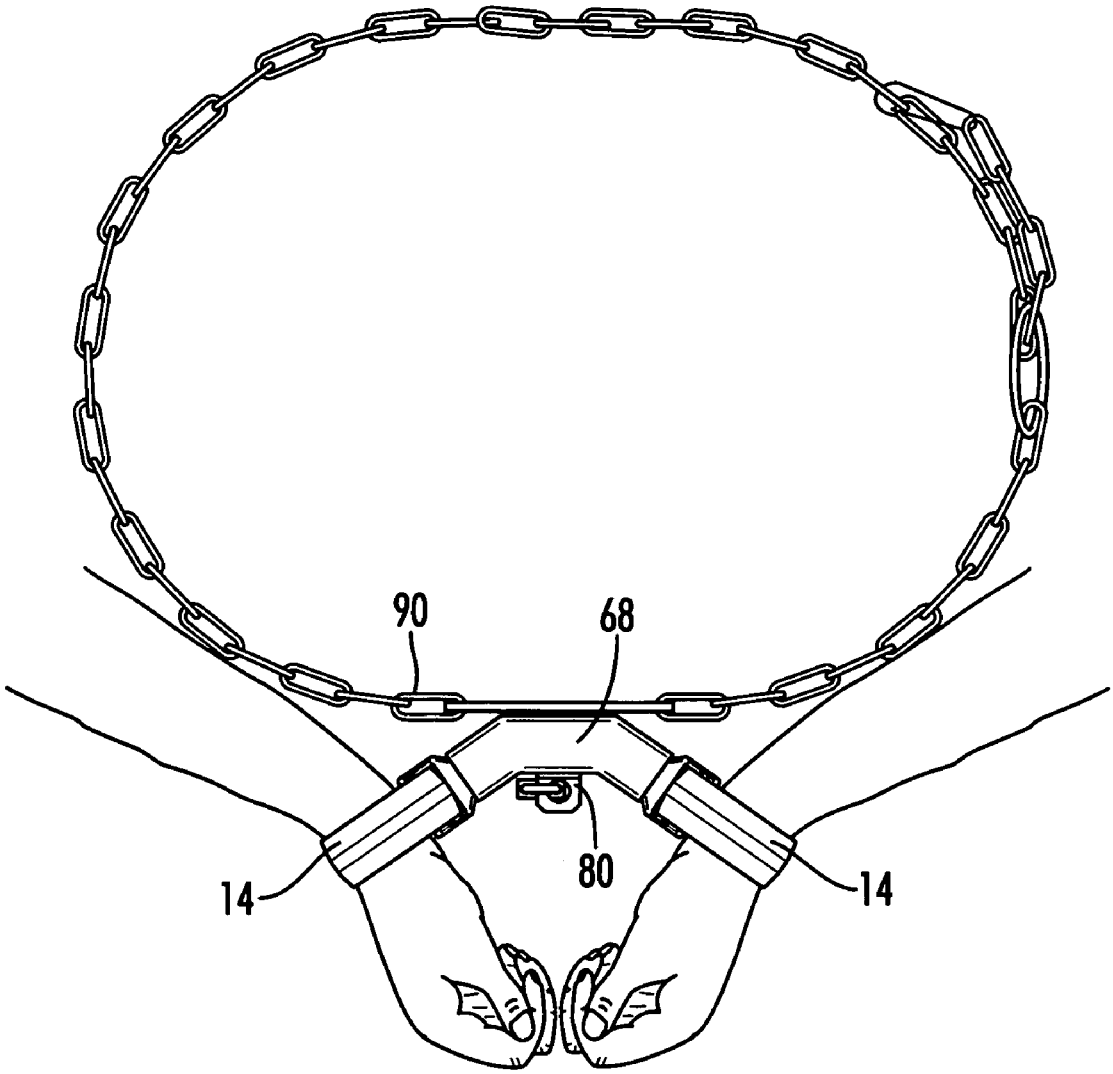
FIG. 2 is a top view of the transport restraint of the present invention as applied to an individual.
Figure 4:
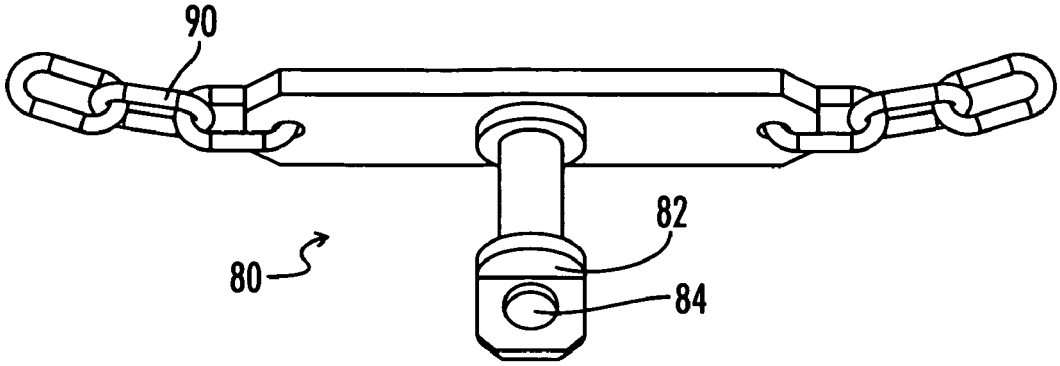
FIG. 4 is a view of the link pin of the present invention.

FIG. 4 shows link pin 80. Link pin 80 has a semicircle-shaped notch 82 which cooperates with hole 240 in cover 68. Link pin 80 further has aperture 84 which cooperates with a padlock (FIG. 2). At the opposite end of link pin 80, the pin attaches to chain 90.

Figure 6:
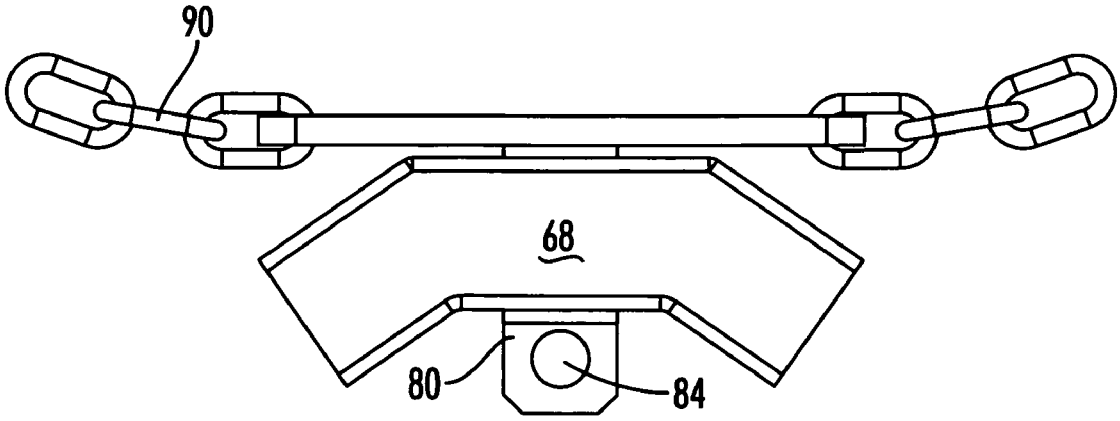
FIG. 6 is a top view of the handcuff cover as attached to the belly chain link pin.

FIG. 6 shows cover 68 with link pin 80 inserted through cover 68.

FIG. 2 shows the restraint system of the present invention. Straps 14 of handcuff 10 encircle the wrists of the restrained individual. Cover 68 is in place over a portion of handcuff 10. Link pin 80 attached to chain 90 is inserted in cover 68 to further restrain movement of the hands.

METHOD OF USE

A method of restraining a person's hands or feet is described. First a slotted strap is secured in a housing so that the strap forms a closed loop. Then the person's hand or foot is inserted through the loop so that the strap is around either the wrist or ankle respectively. The loop is then tightened by pulling the strap through the housing until the desired level of tightness is achieved. The loop is secured in the housing by the force of a tension spring located within the housing, the arm of the tension spring being inserted into a slot of the strap so that the strap cannot be removed and the loop cannot be lengthened or released without a key.

Alternatively, the strap can be inserted in the first channel, then wrapped around the wrist or leg being restrained and then inserted into the second channel.

Once the handcuff is in place, the cover is placed over the fetter linking the two straps or loops together and also partially covering the housings. The link pin, already attached to a belly chain, is inserted from the back side of the cover such that the fetter is above the link pin and secured inside the cover between the link pin and enclosed top of the cover. The link pin is then rotated so that it cannot slide out of the semicircle-shaped apertures in the cover. A padlock is then inserted through the aperture in the link pin, securing the system in place.

Thus, although there have been described particular embodiments of the present invention of a new and useful Inmate Transport Restraint, it is not intended that such references be construed as limitations upon the scope of this invention except as set forth in the following claims.

What is claimed is:

1. A human restraint, comprising a handcuff that comprises two wrist loops and a fetter to hold the loops proximate to one another;

a cover that removably receives at least a portion of the handcuff the cover comprising a top, front, back, and an aperture for receiving a link pin;

a link pin removably receivable by the aperture and shaped to be received by the aperture and inserted in the aperture at a first angle, rotated within the aperture, and held by the aperture at a second angle;

wherein when the pin is held by the aperture the handcuff is securely held by the cover.

2. The restraint of claim 1, wherein the handcuff includes:

a first housing partially enclosing at least a portion of the first loop; and a second housing attached to the first housing and enclosing at least a portion of the second loop.

3. The restraint of claim 2, wherein the fetter attaches the first housing to the second housing.

4. The restraint of claim 1, wherein the fetter is a metal chain.

5. The restraint of claim 2, wherein the first loop and the second loop are not rigid.

6. The restraint of claim 2, wherein the first loop and the second loop are nylon.

7. The restraint of claim 2, wherein the sizes of the first loop and the second loop are adjustable.

8. The restraint of claim 1, comprising an aperture in the cover front and an aperture in the cover back that are alignment with one another, and the link pin is received by both apertures.

9. The restraint of claim 1, wherein the link pin further comprises a padlock hole to receive a padlock.

10. The restraint of claim 1, wherein the cover holds the loops at an angle toward one another.

11. The restraint of claim 10, wherein the cover holds the loops at an angle of about 35 degrees.

12. The restraint of claim 1, wherein the pin comprises a semicircle notch, and the aperture is semi-circled shaped so that the pin can be inserted into the aperture and rotated so that the arcs are oppositely orientated.

13. The restraint device of claim 1, wherein the pin comprises a back plate to hold a belly chain.

14. The restraint of claim 13, wherein the belly chain is held behind the handcuffs.

15. A human restraint, comprising:

a handcuff, the handcuff including:

a first loop;

a first housing partially enclosing at least a portion of the first loop;

a second loop;

a second housing attached to the first housing and enclosing at least a portion of the second loop; and a fetter joining the two houses;

a cover removably enclosing at least a portion of the handcuff, the cover including:

front and back spaced plate members that position the loops in an angle toward one another;

a panel extending between and connected to the plate members; and aligned front and back apertures defined, respectively in the front and back plate members generally in the center portions of the plate members;

a pin to be received by the aligned apertures; and a chain connected to the link pin, wherein the pin and the front aperture have corresponding shapes that, when aligned, allow the pin to be inserted into the aperture at a first angle, and then rotated to a second angle where the pin is held by the misalignment of the pin and the aperture.

16. The restraint of claim 15, wherein the first and second housings each include:

a hollow interior chamber;

a lift cam resting in the chamber;

a tension spring adapted to cooperate with the lift cam;

a free channel which partially opens into the chamber;

a stop channel parallel to the free channel; and a keyhole in communication with the lift cam.

17. The restraint of claim 15, wherein the pin, when inserted into the apertures, is below the fetter.

* * * * *